US005242155A

United States Patent [19]

Thomlinson et al.

[11] Patent Number: 5,242,155

[45] Date of Patent: Sep. 7, 1993

[54] MELTER/HOLDER CONTROL SYSTEM

[75] Inventors: Gordon Thomlinson; Rich Roberts, both of Meadville; John Bargar, Saegertown, all of Pa.

[73] Assignee: Seco/Warwick Corporation, Meadville, Pa.

[21] Appl. No.: 881,171

[22] Filed: May 11, 1992

[51] Int. Cl.[5] ..... C22B 21/00

[52] U.S. Cl. ..... 266/87; 266/242

[58] Field of Search ..... 266/87, 88, 214, 242, 266/275, 280; 432/4, 24, 49, 178; 75/380, 686

[56] References Cited

U.S. PATENT DOCUMENTS 2,543,388 2/1951 Urquhart ..... 432/49
3,625,421 12/1971 Garrison ..... 432/24
4,484,947 11/1984 Marshall ..... 75/686

*Primary Examiner*—Scott Kastler
*Attorney, Agent, or Firm*—Davis Chin

[57] ABSTRACT

A reverberatory aluminum melting/holding furnace is formed of an enclosure for containing a molten metal bath in which a workload to be processed is immersed, a plurality of gas-fired burners for heating the metal bath, and a control system for measuring heat absorbed by the furnace refractory so as to rapidly bring the furnace to a pre-set metal bath temperature without any significant overshoot. The enclosure has a wall layer of insulating refractory material disposed on its interior. The control system includes a first thermocouple element disposed adjacent the "hot face" of the wall layer, and a second thermocouple disposed adjacent the "cold face" of the wall layer. The plurality of gas-fired burners are switched from a "high fire" to a "low fire"/off condition in response to the temperatures sensed by the first and second thermocouple elements prior to reaching of the pre-set metal bath temperature. As a result, the heat stored in the refractory is allowed to heat the metal bath up to the pre-set temperature after the plurality of burners have been switched to the "low fire"/off condition.

5 Claims, 2 Drawing Sheets

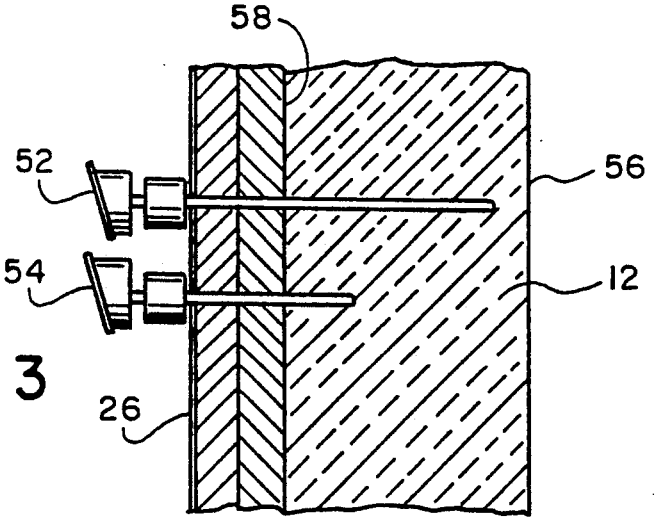
FIG. 3
FIG. 4
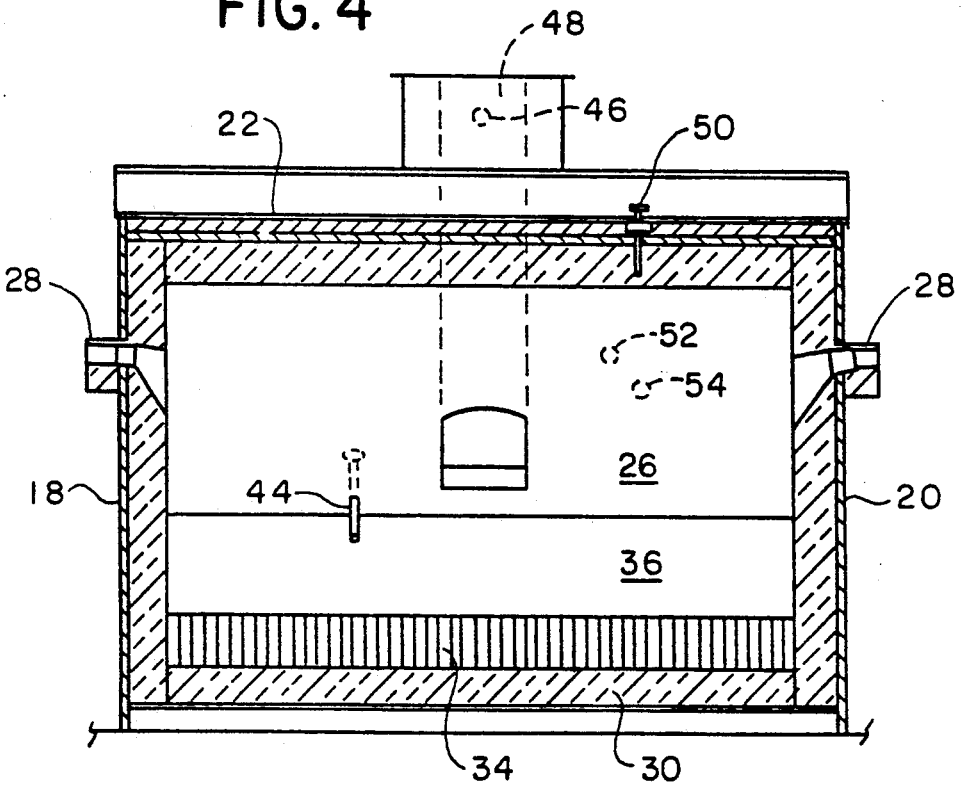

MELTER/HOLDER CONTROL SYSTEM

BACKGROUND OF THE INVENTION

1. Field of the Invention

This invention relates generally to melting or melting/holding furnaces and more particularly, it relates to a control system for reverberatory aluminum melting and melting/holding furnaces which includes means for measuring heat absorbed by the refractories so as to rapidly bring the furnace to the desired metal temperature without any significant overshoot.

2. Description of the Prior Art

As is generally well-known in the heat-treating furnace art, the bringing of a heat-treat metal workload such as aluminum stock materials and the like in a melting or melting/holding furnace to the desired metal processing temperature without any significant overshoot has always presented problems. The heat treating cycle requires that the aluminum material be raised to a fairly specific temperature such as 1400° F. and soaked at that preselected processing temperature for a substantial period of time. It is extremely important that the aluminum material not be heated higher than the target temperature since various types of deterioration occur at these elevated temperatures. For example, such overshoot in the homogenizing of aluminum billets would result in excessive, undesirable grain growth in the aluminum. Further, the higher temperatures may also cause additional metal loss and promote the formation of dross.

A considerable amount of development has already taken place in the design of furnace-heating control systems for rapidly bringing the metal workload up to the processing temperature without any undesirable overshoot. These prior art control systems have not, however, employed thermocouple control of the heating chamber since a thermocouple extending into the firing chamber, either through the furnace sidewalls or roof, would be prone to damage by charging and cleaning practices in the heat-treating furnace art. Such conventional control systems generally include: (1) a flue thermocouple, (2) a roof overtemperature thermocouple embedded in the brickwork but not exposed directly to the furnace chamber, and (3) a bath thermocouple which is retracted in the furnace wall until a molten bath condition is achieved.

In operation of the prior art control systems, after charging of the furnace with the cold aluminum material the furnace is then operated with its gas-fired burners at "high fire" condition until the pre-set flue temperature has been reached as sensed by the flue thermocouple. The burners of the furnace are maintained in the "high fire" condition until the bath thermocouple is inserted into the molten metal for measuring its temperature. When the pre-set temperature has been reached, the burners are switched to a "low fire" or off condition.

However, the furnace is lined with high density-refractory materials which absorb heat during the burner firing cycle, and such refractory materials are exposed to temperatures up to 1,000° F. higher than the final desired aluminum material. While the burners are switched to the "low fire" or off condition at the end of the firing cycle, the stored heat in the refractory materials will continue to radiate heat into the molten bath so as to produce a significant overshoot in the temperature. Thus, the energy absorbed by the molten bath is lost and it is therefore necessary to reduce the aluminum temperature to the desired value, either in the furnace or after transferring it to a holding furnace prior to casting.

It would therefore be desirable to provide an improved control system for reverberatory aluminum melting and melting/holding furnaces which includes means for measuring the heat absorbed by the refractories so as to rapidly bring the furnace to the desired metal temperature without any significant overshoot.

A state of the art search directed to the subject matter of this application uncovered the following U.S. Pat. Nos.:

U.S. Pat. No. 3,610,045
U.S. Pat. No. 4,324,129
U.S. Pat. No. 4,534,663
U.S. Pat. No. 4,567,849

There is disclosed in U.S. Pat. No. 3,610,045 to Wilbur E. Shearman issued on Oct. 5, 1971, an apparatus for obtaining continuous temperature measurement in a bath of molten iron. The apparatus includes a thermocouple disposed within a hollow ceramic refractory protective sheath having a portion thereof protruding within the melt. The wall thickness of the sheath is relatively thin at the tip and is of relatively greater wall thickness at the intersection of the sheath with the "hot face" of the furnace wall. The sheath is embedded into the furnace wall for a substantial length so as to provide the unit having a greatly increased life and a very accurate temperature measurement.

There is disclosed in U.S. Pat. No. 4,324,129 to Hiroshi J. Goldsmid issued on Apr. 13, 1982, a thermal comparator for use in identifying material such as gemstones which comprises a thermocouple to be applied to a material that includes two dissimilar metals and having junctions spaced relatively close to each other and forming thermocouple branches and a high thermal conductivity tip at one of the junctions. One branch is connected to a source of heat at least up to just prior to making contact between the thermocouple and the material to be tested so that the one branch forms the main heat source for at least a short time after the tip of one of the junctions is placed in contact with the material to be identified.

In U.S. Pat. No. 4,534,663 to Heinz F. Poppendiek issued on Aug. 13, 1985, there is taught an apparatus for measuring or comparing the quality of different heat insulation materials which includes a housing structure for confining two different insulation materials in corresponding rectangular cavities and on opposite sides of a special flat heat source.

In U.S. Pat. No. 4,567,849 to Chang-Feng Wan issued on Feb. 4, 1986, there is disclosed a differential thermal analysis apparatus which includes a first thermocouple 24 disposed within the reactor and a second thermocouple 30 disposed within a neutral body 16. The differential voltage between the two thermocouples 24 and 30 is sensed to provide a DTA measurement of transformation points of the melt 18.

However, none of the prior art uncovered in the search disclosed a melting/holding furnace like that of the present invention which includes a first thermocouple element disposed adjacent the "hot face" of the furnace wall layer and a second thermocouple element disposed adjacent the "cold face" of the wall layer.

SUMMARY OF THE INVENTION

Accordingly, it is a general object of the present invention to provide an improved control system for melting/holding furnaces which is relatively simple and economical to manufacture and assemble, but yet overcomes all of the disadvantages of the prior art furnaces.

It is an object of the present invention to provide an improved control system for reverberatory aluminum melting and melting/holding furnaces which includes means for measuring heat absorbed by the refractories so as to rapidly bring the furnace to desired metal temperature without any significant overshoot.

It is another object of the present invention to provide an improved control system for reverberatory aluminum melting/holding furnaces which includes a first thermocouple element disposed adjacent the "hot face" of the furnace wall layer and a second thermocouple element disposed adjacent the "cold face" of the wall layer.

In accordance with these aims and objectives, the present invention is concerned with the provision of a reverberatory aluminum melting/holding furnace which includes an enclosure for containing a molten metal bath in which a workload to be processed is immersed, a plurality of gas-fired burners for heating the metal bath, and a control system for measuring heat absorbed by the furnace refractories so as to rapidly bring the furnace to a pre-set metal bath temperature without any significant overshoot. The enclosure includes a wall layer of insulating refractory material disposed on its interior. The control system includes a first thermocouple element disposed adjacent the "hot face" of the wall layer, and a second thermocouple element disposed adjacent the "cold face" of the wall layer.

The plurality of gas-fired burners are switched from a "high fire" condition to a "low fire"/off condition in response to the temperatures sensed by the first and second thermocouple elements prior to reaching of the pre-set metal bath temperature. The temperatures sensed by the first and second thermocouple elements are used to determine the amount of heat absorbed by the furnace refractories, and the stored heat in the refractories is allowed to heat the metal bath up to the pre-set temperature after the plurality of burners have been switched to the "low fire"/off condition.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein:

FIG. 3 is an enlarged view of the encircled area of FIG. 1; and

FIG. 4 is a left end view of the furnace of FIG. 1.

DESCRIPTION OF THE PREFERRED EMBODIMENT

Figure 1:
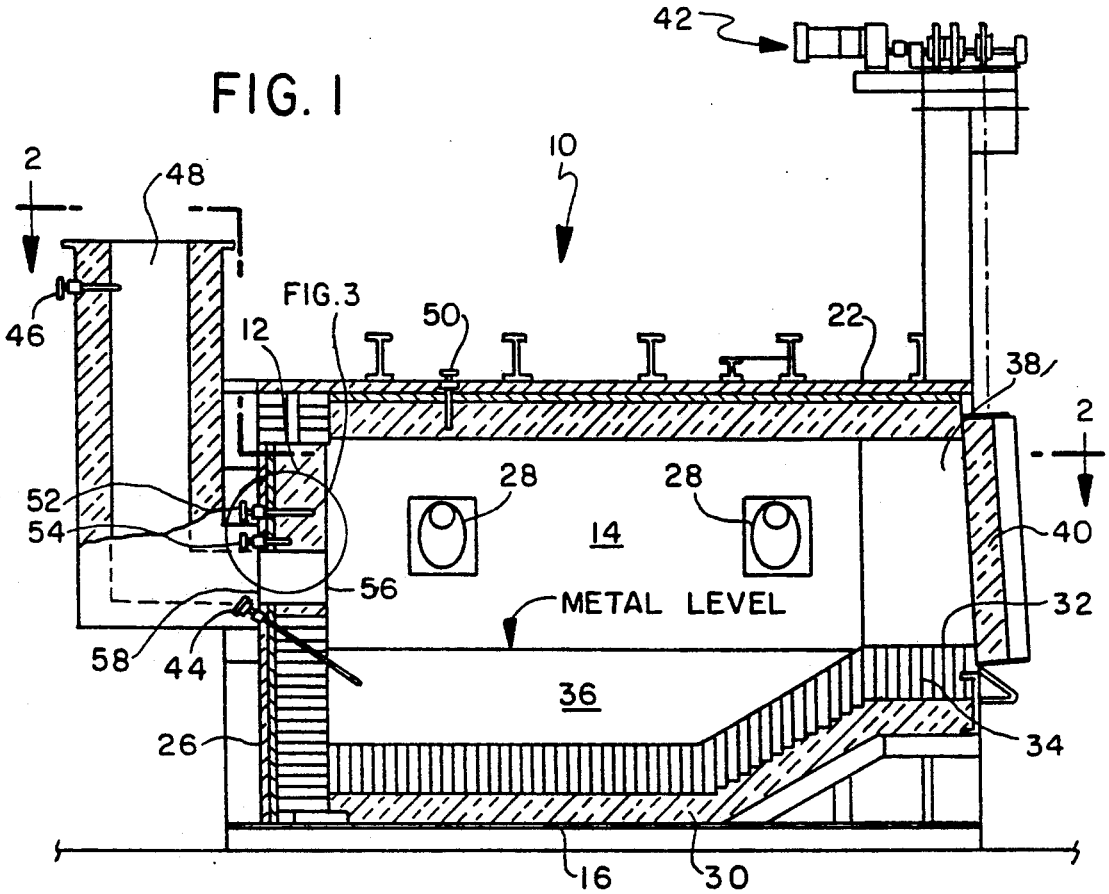
FIG. 1 is a longitudinal, cross-sectional view of a melting/holding furnace, embodying the control means of the present invention.
Figure 2:
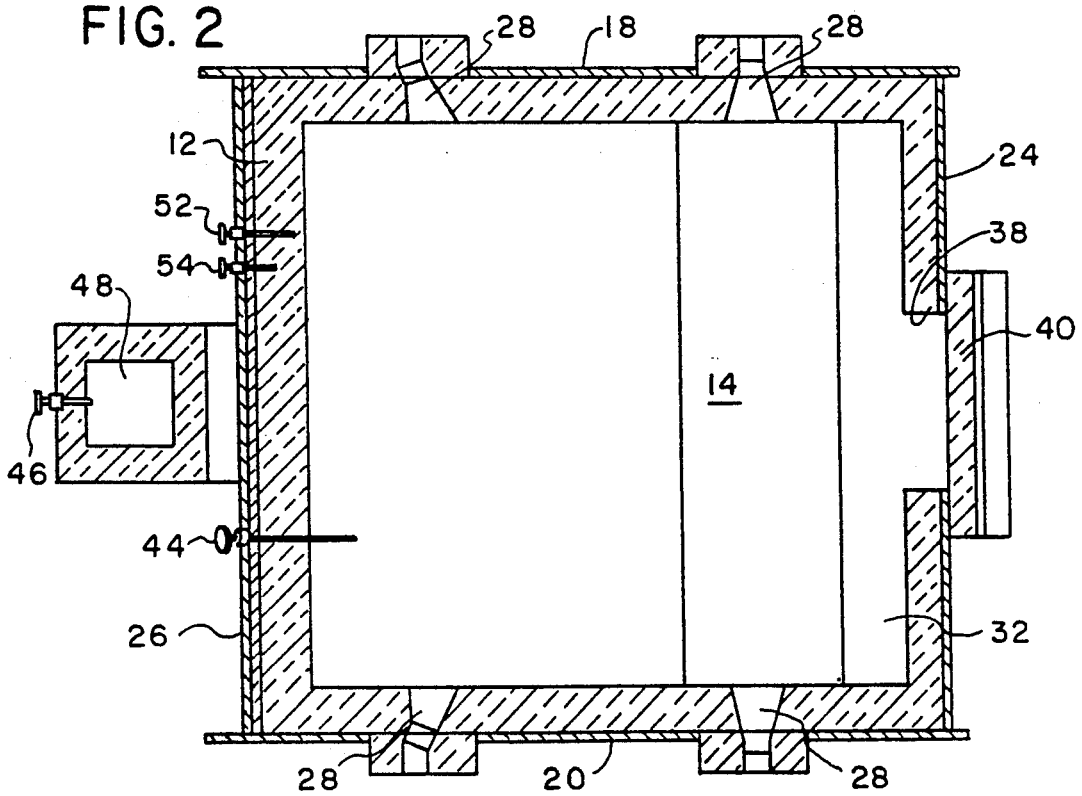
FIG. 2 is a top plan view, taken along the lines 2—2 of the furnace of FIG. 1.

Referring now in detail to the drawings, there is shown a reverberatory aluminum melting/holding furnace generally designated by reference numeral 10 and constructed in accordance with the principles of the present invention. From a structural standpoint, the melting/holding furnace 10 is of a conventional design being of sheet metal construction with a wall layer 12 of insulating refractory material such as high alumina plastic disposed on the interior to form an insulated enclosure 14. The melting/holding furnace 10 includes a base 16, a pair of vertical side walls 18 and 20 connected to the base 16, a top wall 22 connected to the side walls, a front wall 24 connected to the base, the side walls, and the top wall, and a rear wall 26 connected also to the base, the side walls, and the top wall. A plurality of conventional gas-fired burners 28 are positioned throughout the enclosure 14 defined by the top wall 22, side walls 18 and 20, front wall 24, and rear wall 26 for delivering a hot gaseous medium. In alternative embodiments, the enclosure 14 of the furnace may be heated by radiant tube gas fired heaters or electric heaters.

The base 16 has disposed on its interior surface a high strength castable 30 adapted for supporting a ramp 32. The ramp 32 is preferably made of a high alumina phosphorus-bonded brickwork 34. The enclosure contains a molten metal bath 36 into which the workload (not shown) such as aluminum stock material is immersed for heat treating. The front wall has an opening 38 to permit the insertion and removal of the workload. A door 40 is mounted for vertical slidable movement by a door hosting means generally designated by reference numeral 42 into and out of a position adjacent to the front opening 38 for sealing the furnace enclosure 14.

In order to measure the temperature of the molten bath 36, there is provided a retractable bath thermocouple 44 which extends through the rear wall 26 and may be inserted into and out of the molten bath 36 from time to time. Further, there is provided a flue thermocouple 46 which extends into a flue 48 for measuring the temperature of the outgoing gas. Further, an overtemperature thermocouple 50 is embedded in the roof brickwork or top wall 22 of the furnace but does not extend into the furnace enclosure 14. The roof thermocouple couple 50 is used to measure the temperature of the furnace refractory. As thus far described, the furnace is quite conventional in nature.

The present invention is directed to an improved control system for the reverberatory melting/holding furnace for heat treating the aluminum stock material in order to bring the same up to a desired target temperature as quickly and accurately as possible without any significant overshoot. In order to avoid the possibility of overshooting the target temperature, the improved control system includes means for measuring the heat absorbed by the refractories in the wall layer 12 so that the plurality of burners 28 can be switched from "high fire" condition to a "low fire" or off condition before the bath thermocouple 44 reaches a pre-set molten metal temperature. In this manner, the burners 28 are switched off earlier than in the prior art furnaces so that the heat stored in the refractories can be thereafter usefully employed to continue to heat the molten bath 36 to the pre-set metal temperature. As a result, there is prevented any significant overshooting of the target metal temperature.

As can best be seen from FIG. 3, the measurement control means of the present invention includes a first refractory thermocouple element 52 which is located in the upper portion of the rear wall 26 and is positioned to be approximately three inches away from the "hot face"

of the wall layer 12 and a second refractory thermocouple 54 which is located also in the upper portion of the rear wall 26 and is disposed several inches below the first refractory thermocouple element 52. The second thermocouple element 54 is positioned to be approximately two inches inside the "cold face" of the wall layer 12.

As used herein, the term "hot face" refers to the inner surface 56 of the furnace refractory wall layer 12 and the term "cold face" refers to the outer surface 58 of the wall layer 12. Thus, the inner surface 56 is in contact with the molten metal bath 36 and will be generally at a higher temperature than the outer surface 58. Of course, it should be apparent that in a cold furnace the temperature measured by the first thermocouple element 52 will be much higher than the temperature measured by the second thermocouple element 54 since the refractory wall 12 has not yet been fully soaked out.

In operation, at the start-up of a heat-treating process cycle the workload or aluminum stock material is inserted into the molten metal bath 36 inside of the furnace enclosure 14. Then, the gas-fired burners 28 are switched on "high fire," i.e., a firing temperature of approximately 2400° F. It will be assumed that the target temperature of the metal at which it is to be held is approximately 1400° F. After the start-up of the loaded furnace the incoming temperature of the enclosure will be reached relatively rapidly. By using the temperatures measured by the first and second thermocouple elements 52 and 54, the amount of usable heat stored in the furnace refractory in the walls and roof can be determined by conventional methods known to those skilled in the art. Based upon this determination, the plurality of gas-fired burners 28 can be driven to "low fire" or off condition at a pre-determined temperature (i.e., 1290° F., which is below the pre-set temperature) before the pre-set temperature of the metal (1400° F. in this case) has been reached. As a result, the significant overshoot in temperature in the prior art furnaces caused by the heat stored in the refractories to radiate heat into the molten metal bath 36 has thus been eliminated.

It should be apparent that the control system of the present invention may include a conventional comparator for comparing the actual temperature of the molten bath 36 sensed by the bath thermocouple 44 with the pre-determined temperature of 1290° F. When the actual bath temperature exceeds this predetermined temperature, a motor (not shown) could be driven reversely so as to drive a heat input valve (not shown) associated with the gas-fired 28 from a normal opening position to a closing position. In this manner, the burners 28 may be switched from the "high fire" condition to the "low fire"/off condition.

From the foregoing detailed description, it can thus be seen that the present invention provides an improved control system for a reverberatory aluminum melting/holding furnace which includes a first thermocouple element disposed adjacent the "hot face" of the furnace wall layer and a second thermocouple element disposed adjacent the "cold face" of the wall layer. As a result, the burners can be switched from a "high fire" condition to a "low fire"/off condition in response to the temperature sensed by the first and second thermocouple elements prior to reaching of a pre-set metal bath temperature, thereby eliminating any significant overshooting of the metal bath temperature due to the stored heat in the refractories.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. In a reverberatory aluminum melting/holding furnace having an enclosure for containing a molten metal bath in which a workload to be processed is immersed, said enclosure including a wall layer of insulating refractory material disposed on its interior, a plurality of gas-fired burners for heating the molten bath, and a control system for measuring heat absorbed by the furnace refractory so as to rapidly bring the furnace to a pre-set metal bath temperature without any significant overshoot, said control system comprising:

first temperature sensing means being disposed near a "hot face" of said wall layer;

second temperature sensing means being disposed near a "cold face" of said wall layer; and said plurality of gas-fired burners being switched from a "high-fire" condition where said burners are fully turned on to a "low fire" condition where said burners are turned off in response to the temperature sensed by said first and second temperature sensing means prior to reaching of the pre-set metal bath temperature, whereby said temperature sensed by said first and second temperature sensing means are used to determine the amount of heat absorbed by the furnace refractories and the stored heat in the refractories is allowed to heat the metal bath up to the pre-set temperature after said plurality of burners have been switched to the "low fire" condition.

2. In a reverberatory aluminum melting/holding furnace as claimed in claim 1, wherein said first temperature sensing means comprises a first thermocouple element.

3. In a reverberatory aluminum melting/holding furnace as claimed in claim 2, wherein said second temperature sensing means comprises a second thermocouple element.

4. In a reverberatory aluminum melting/holding furnace as claimed in claim 3, wherein said first thermocouple element is located in the upper portion of a rear wall of said enclosure and is positioned to be approximately three inches away from the "hot face" of said wall layer.

5. In a reverberatory aluminum melting/holding furnace as claimed in claim 4, wherein said second thermocouple element is also located in the upper portion of the rear wall of said enclosure and is positioned to be approximately two inches inside of the "cold face" of said wall layer.

* * * * *